US012516808B2

(12) United States Patent
Cadima

(10) Patent No.: US 12,516,808 B2
(45) Date of Patent: Jan. 6, 2026

(54) GAS BURNER ASSEMBLY AND COOKTOP APPLIANCE

(71) Applicant: Haier US Appliance Solutions, Inc., Wilmington, DE (US)

(72) Inventor: Paul Bryan Cadima, Crestwood, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 450 days.

(21) Appl. No.: 18/096,254

(22) Filed: Jan. 12, 2023

(65) Prior Publication Data

US 2024/0240786 A1 Jul. 18, 2024

(51) Int. Cl.
*F23D 14/06* (2006.01)
*F23D 14/62* (2006.01)

(52) U.S. Cl.
CPC ..... *F23D 14/06* (2013.01); *F23D 14/62* (2013.01)

(58) Field of Classification Search
CPC .. F24C 3/08; F24C 3/082; F24C 3/085; F23D 2900/14061; F23D 2900/14062; F23D 2900/14063; F23D 2900/14021; F23D 14/02; F23D 14/06; F23D 14/58; F23D 14/62
USPC ..... 126/39 E
See application file for complete search history.

(56) References Cited

U.S. PATENT DOCUMENTS

| | | | | |
|---|---|---|---|---|
| 5,408,984 | A | 4/1995 | Maughan | |
| 6,132,205 | A | 10/2000 | Harneit | |
| 7,819,657 | B2 | 10/2010 | Molla | |
| 8,221,116 | B2 | 7/2012 | Biagioli et al. | |
| 8,408,897 | B2 | 4/2013 | Rossi et al. | |
| 8,616,193 | B2 | 12/2013 | Padgett | |
| 8,887,710 | B2 | 11/2014 | Rossi et al. | |
| 9,151,494 | B2 | 10/2015 | Gianluca | |
| 10,041,683 | B2 | 8/2018 | Cadima | |
| 10,401,025 | B2 | 9/2019 | Breccia et al. | |
| 10,415,824 | B2 | 9/2019 | Cadima | |
| 11,402,101 | B2 | 8/2022 | Cadima et al. | |
| 2008/0241777 | A1* | 10/2008 | Rossi | F23D 14/06 126/39 R |
| 2014/0090636 | A1 | 4/2014 | Bettinzoli | |

(Continued)

FOREIGN PATENT DOCUMENTS

| | | | |
|---|---|---|---|
| CN | 105987383 | A | 10/2016 |
| CN | 110410785 | A | 11/2019 |

(Continued)

*Primary Examiner* — Steven B McAllister
*Assistant Examiner* — Xiaoting Hu
(74) *Attorney, Agent, or Firm* — Dority & Manning, P.A.

(57) ABSTRACT

A cooktop appliance and a gas burner assembly are provided. The gas burner assembly includes an annular burner body positioned at a top surface of a top panel of the cooktop appliance. The burner body forms a central combustion zone, a plurality of flame ports at the central combustion zone, and a mixing chamber upstream from the plurality of flame ports. A fuel manifold forms an outlet passage spaced apart from an inlet at the burner body such that gaseous fuel is flowable from the outlet passage at the fuel manifold into the mixing chamber through the inlet at the burner body, and such that air is entrained into the mixing chamber by the flow of gaseous fuel entering the mixing chamber through the inlet at the burner body.

18 Claims, 9 Drawing Sheets

(56) References Cited

U.S. PATENT DOCUMENTS

| | | | | |
|---|---|---|---|---|
| 2015/0040887 | A1 | 2/2015 | Angulo | |
| 2019/0145626 | A1* | 5/2019 | Cadima | F23D 14/065 126/39 E |
| 2022/0049850 | A1* | 2/2022 | Cadima | F24C 15/34 |

FOREIGN PATENT DOCUMENTS

| | | | |
|---|---|---|---|
| EP | 1406043 | A1 | 4/2004 |
| EP | 2439454 | A1 | 4/2012 |
| JP | H083841 | Y2 | 1/1996 |
| JP | 2016200375 | A | 12/2016 |
| JP | 2019219157 | A | 12/2019 |
| JP | 2020094714 | A | 6/2020 |

* cited by examiner

GAS BURNER ASSEMBLY AND COOKTOP APPLIANCE

FIELD

The present subject matter relates generally to cooktop appliances with gas burner assemblies, such as gas range appliances or gas stove appliances.

BACKGROUND

Certain cooktop appliances include gas burners for heating cooking utensils on the cooktop appliances. Gas burners that fire inwards, typically with a swirling flame pattern, offer better efficiency than traditional outward firing gas burners. However, known inward firing gas burners have various drawbacks.

One problem with known inward firing gas burners is that a center of the inward firing gas burners is open. A portion of the top panel below the open center is perforated to allow components of the inward firing gas burners to pass through the top panel, but spills can also pass through the perforated top panel. Such spills can be difficult to clean.

Other known inward firing gas burners have components, such as surfaces, passages and channels, at a center of the inward firing gas burner. Spills frequently collect on such components and are difficult to clean. The spills can also stain the components, particularly when the components are formed of porous cast metal, and stains are unsightly. Separate from or in addition to damage caused by spills, the high heat generated by the burner can cause or exacerbate damage to the center surface(s). For instance, portions of a component (e.g., top panel, including surface coatings on the top panel) within the center may warp, crack, discolor, or craze over time. Moreover, directing secondary combustion air through the inward firing gas burners can also be difficult. Structures to overcome such difficulties may require tight manufacturing tolerances to produce tight fits between the burner, fuel manifold, or cooktop surface. Such tight tolerances may cause inward firing gas burners to be expensive, and prone to leakage if the tolerances are not maintained sufficiently tight.

Accordingly, a cooktop appliance with features for limiting damage from heat or spills at, for instance, a top panel of the cooktop appliance would be useful. In particular, it would be advantageous to provide a cooktop appliance having features to manage or reduce heat at panel within a central portion of a burner. Furthermore, a burner assembly addressing several of the above issues would be advantageous and beneficial.

BRIEF DESCRIPTION

Aspects and advantages of the invention will be set forth in part in the following description, or may be obvious from the description, or may be learned through practice of the invention.

An aspect of the present disclosure is directed to a cooktop appliance including a top panel and a gas burner assembly positioned at the top panel. The gas burner assembly includes an annular burner body positioned at a top surface of the top panel. The annular burner body forms a central combustion zone, a plurality of flame ports at the central combustion zone, and a mixing chamber upstream from the plurality of flame ports to permit a fuel-air mixture to flow into the central combustion zone through the plurality of flame ports. The burner body is open at the central combustion zone such that a circumferentially bounded portion of the top panel is vertically exposed through the annular burner body at the central combustion zone. A fuel manifold is positioned beneath the top panel and upstream from the mixing chamber at the burner body. The fuel manifold forms an outlet passage spaced apart from an inlet at the burner body such that gaseous fuel is flowable from the outlet passage at the fuel manifold into the mixing chamber through the inlet at the burner body, and such that air is entrained into the mixing chamber by the flow of gaseous fuel entering the mixing chamber through the inlet at the burner body.

Another aspect of the present disclosure is directed to gas burner assembly for a cooktop appliance. The burner assembly includes an annular burner body disposable at a top surface of a top panel of the cooktop appliance. The burner body forms a central combustion zone, a plurality of flame ports at the central combustion zone, and a mixing chamber upstream from the plurality of flame ports to permit a fuel-air mixture to flow into the central combustion zone through the plurality of flame ports. The burner body is open at the central combustion zone such that a circumferentially bounded portion of the top panel is vertically exposed through the annular burner body at the central combustion zone. A fuel manifold is disposable beneath the top panel and upstream from the mixing chamber at the burner body. The fuel manifold forms an outlet passage spaced apart from an inlet at the burner body such that gaseous fuel is flowable from the outlet passage at the fuel manifold into the mixing chamber through the inlet at the burner body, and such that air is entrained into the mixing chamber by the flow of gaseous fuel entering the mixing chamber through the inlet at the burner body.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
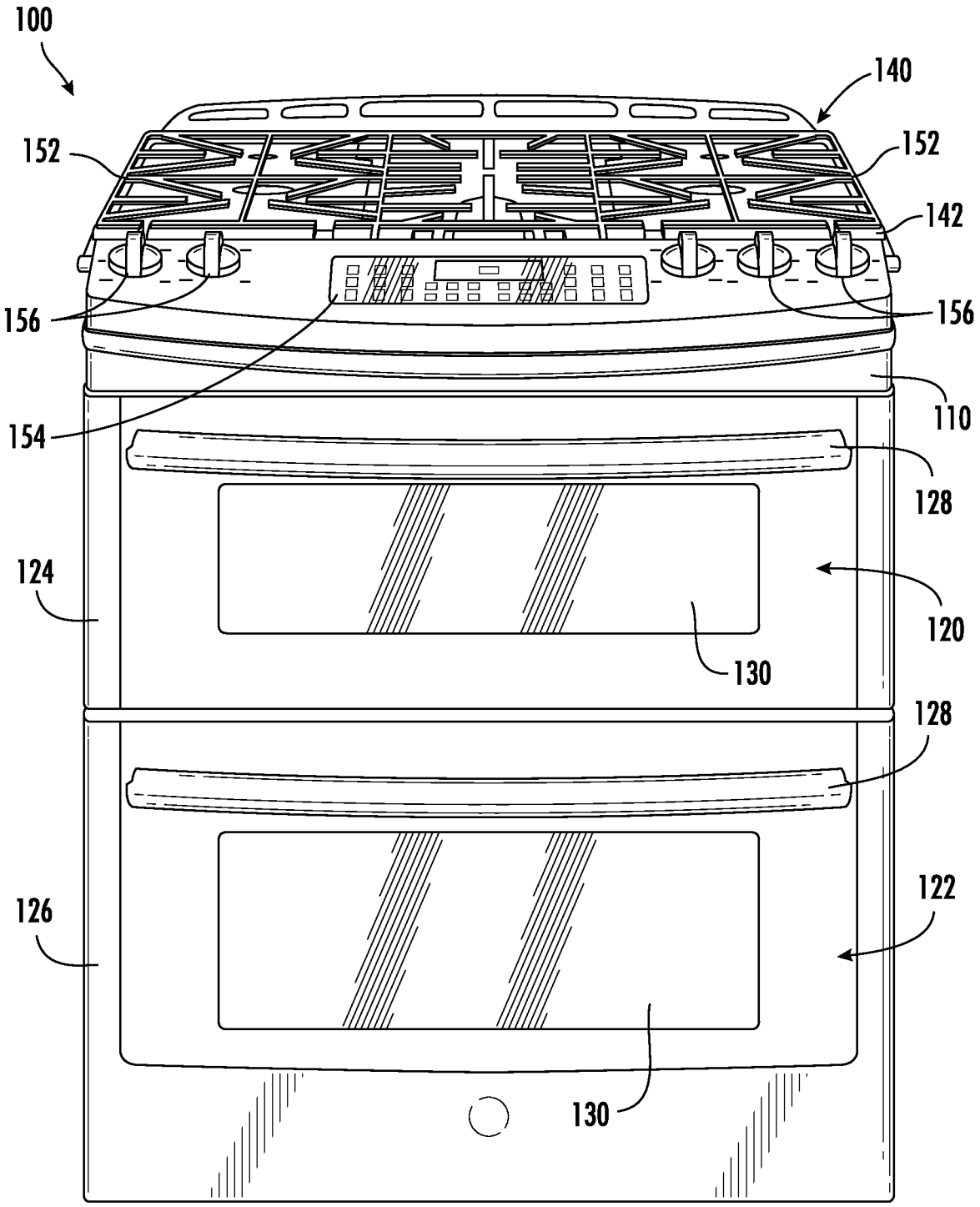
FIG. 1 provides a front, perspective view of a range appliance according to an exemplary embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "or" is generally intended to be inclusive (i.e., "A or B" is intended to mean "A or B or both"). The terms "first," "second," and "third" may be used interchangeably to distinguish one component from another and are not intended to signify location or importance of the individual components. The terms "upstream" and "downstream" refer to the relative flow direction with respect to fluid flow in a fluid pathway. For example, "upstream" refers to the flow direction from which the fluid flows, and "downstream" refers to the flow direction to which the fluid flows.

Figure 2:
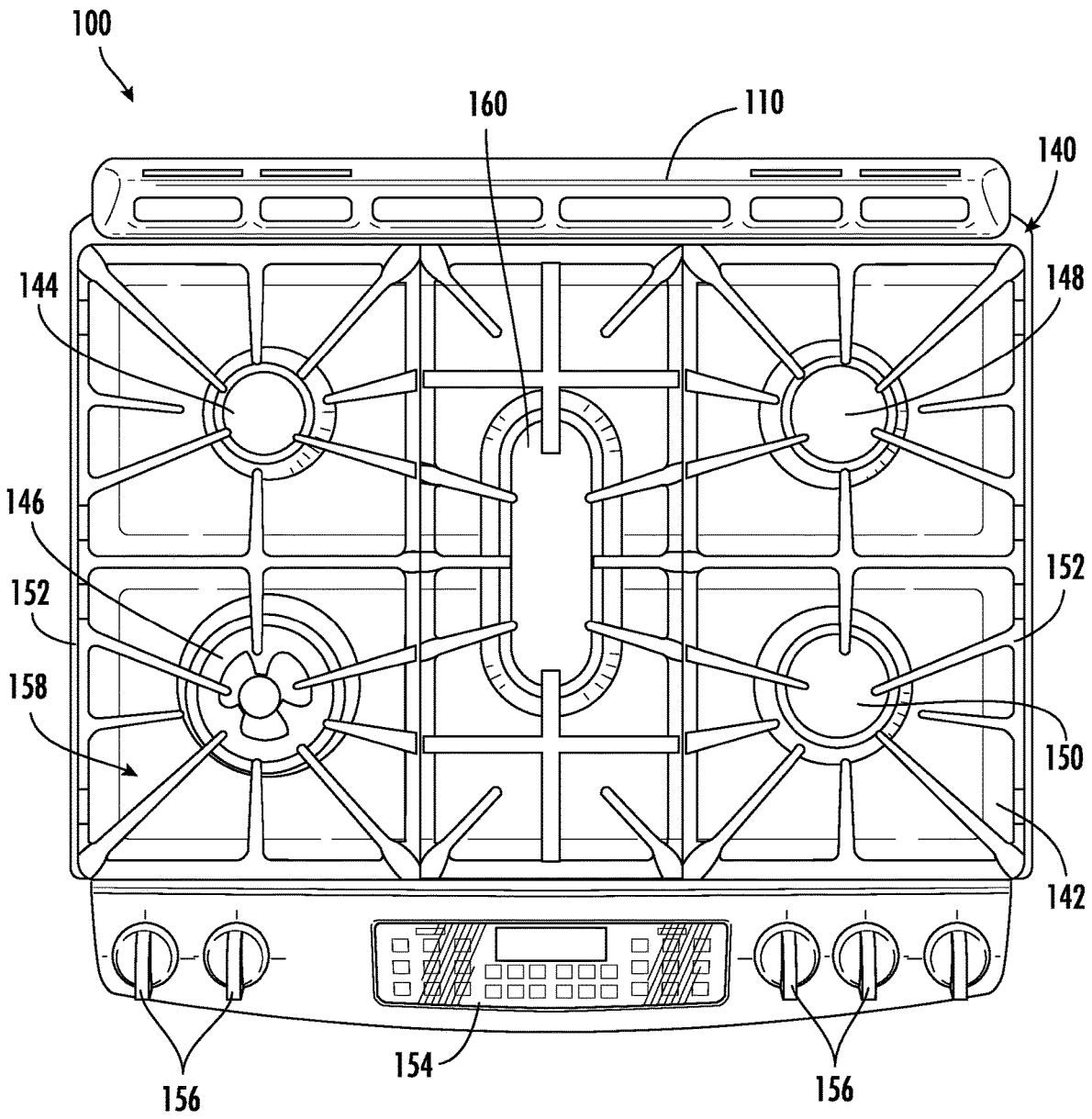
FIG. 2 provides a top, plan view of the exemplary range appliance of FIG. 1.
Figure 3:
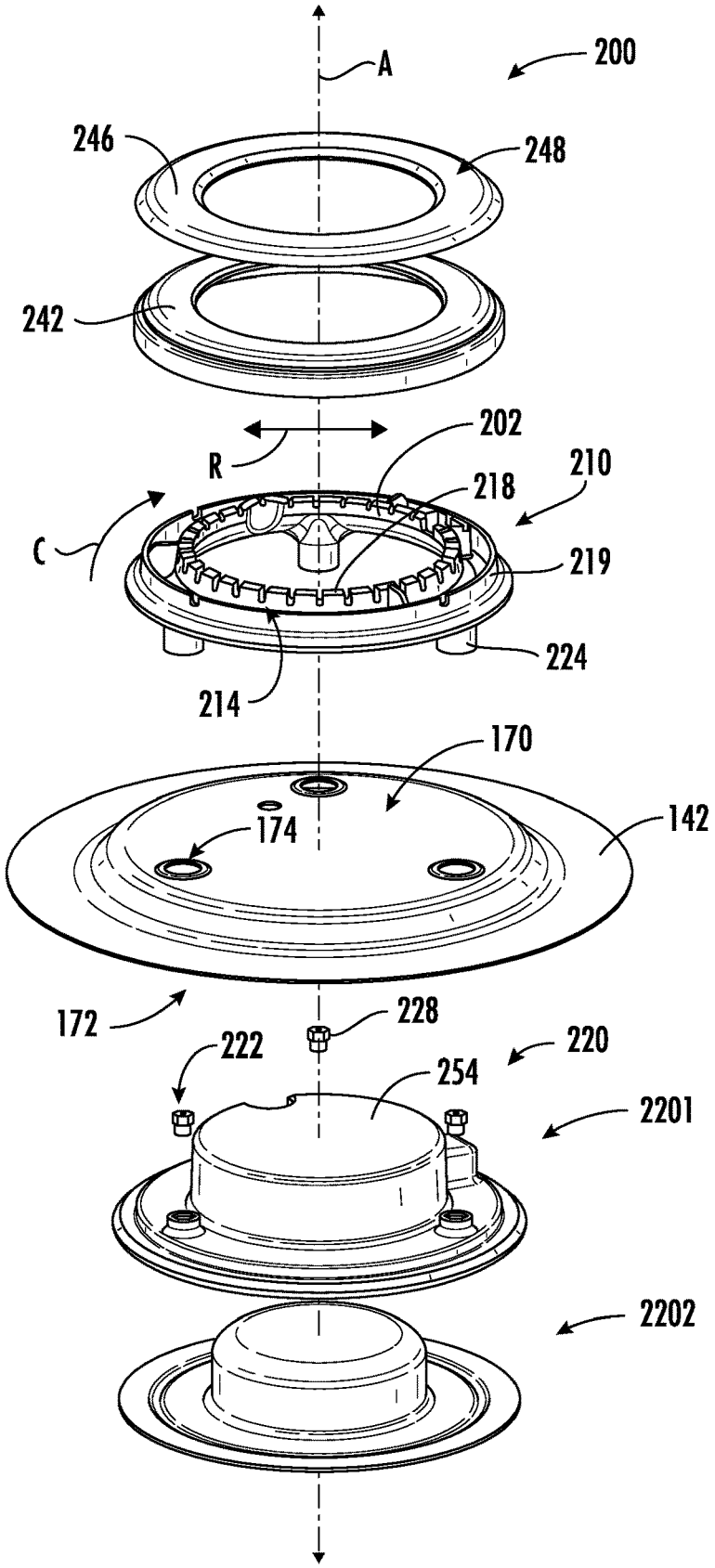
FIG. 3 provides an exploded view of an exemplary burner assembly in accordance with embodiments of the present disclosure.

Turning now to the figures, FIG. 1 provides a front, perspective view of a range appliance 100 as may be employed with the present disclosure. FIG. 2 provides a top, plan view of range appliance 100. Range appliance 100 includes an insulated cabinet 110. Cabinet 110 defines an upper cooking chamber 120 and a lower cooking chamber 122. Thus, range appliance 100 is generally referred to as a double oven range appliance. As will be understood by those skilled in the art, range appliance 100 is provided by way of example only, and the present disclosure may be used in any suitable appliance (e.g., a single oven range appliance or a standalone cooktop appliance). Thus, the exemplary embodiment shown in FIG. 1 is not intended to limit the present disclosure to any particular cooking chamber configuration or arrangement.

Upper and lower cooking chambers 120 and 122 are configured for the receipt of one or more food items to be cooked. Range appliance 100 includes an upper door 124 and a lower door 126 rotatably attached to cabinet 110 in order to permit selective access to upper cooking chamber 120 and lower cooking chamber 122, respectively. Handles 128 are mounted to upper and lower doors 124 and 126 to assist a user with opening and closing doors 124 and 126 in order to access cooking chambers 120 and 122. As an example, a user can pull on handle 128 mounted to upper door 124 to open or close upper door 124 and access upper cooking chamber 120. Glass windowpanes 130 provide for viewing the contents of upper and lower cooking chambers 120 and 122 when doors 124 and 126 are closed and also assist with insulating upper and lower cooking chambers 120 and 122. Heating elements (not shown), such as electric resistance heating elements, gas burners, microwave heating elements, halogen heating elements, or suitable combinations thereof, are positioned within upper cooking chamber 120 and lower cooking chamber 122 for heating upper cooking chamber 120 and lower cooking chamber 122.

Range appliance 100 also includes a cooktop 140. Cooktop 140 is positioned at or adjacent a top portion of cabinet 110. Thus, cooktop 140 is positioned above upper and lower cooking chambers 120 and 122. Cooktop 140 includes a top panel 142. By way of example, top panel 142 may be constructed of glass, ceramics, enameled steel, and combinations thereof. Moreover, top panel 142 may be formed as a unitary, single piece or, alternatively, as multiple discrete pieces joined together.

For range appliance 100, a utensil holding food or cooking liquids (e.g., oil, water, etc.) may be placed onto grates 152 at a location of any of burner assemblies 144, 146, 148, 150. Burner assemblies 144, 146, 148, 150 provide thermal energy to cooking utensils on grates 152. As shown in FIG. 1, burners assemblies 144, 146, 148, 150 can be configured in various sizes so as to provide, for example, for the receipt of cooking utensils (e.g., pots, pans, etc.) of various sizes and configurations and to provide different heat inputs for such cooking utensils. Grates 152 may be supported on a top surface 158 of top panel 142. In optional embodiments, range appliance 100 includes a griddle burner 160 positioned at a middle portion of top panel 142, as may be seen in FIG. 2. A griddle may be positioned on grates 152 and heated with griddle burner 160.

A user interface panel 154 is located within convenient reach of a user of the range appliance 100. For this exemplary embodiment, user interface panel 154 includes knobs 156 that are each associated with one of burner assemblies 144, 146, 148, 150 and griddle burner 160. Knobs 156 allow the user to activate each burner assembly and determine the amount of heat input provided by each burner assembly 144, 146, 148, 150 and griddle burner 160 to a cooking utensil located thereon. User interface panel 154 may also be provided with one or more graphical display devices that deliver certain information to the user such as, for example, whether a particular burner assembly is activated or the rate at which the burner assembly is set.

Although shown with knobs 156, it should be understood that knobs 156 and the configuration of range appliance 100 shown in FIG. 1 is provided by way of example only. More specifically, user interface panel 154 may include various input components, such as one or more of a variety of touch-type controls, electrical, mechanical or electro-mechanical input devices including rotary dials, push buttons, and touch pads. The user interface panel 154 may include other display components, such as a digital or analog display device designed to provide operational feedback to a user.

Turning now to FIGS. 3 through 11, various views are provided of a gas burner assembly 200 according to an exemplary embodiment of the present disclosure. As an example, burner assembly 200 may be used in range appliance 100 (FIG. 2) as one of burner assemblies 144, 146, 148, 150. Nonetheless, it will be understood that, while describe in greater detail below in the context of range appliance 100, burner assembly 200 may be used in or with any suitable appliance in alternative exemplary embodiments.

Generally, burner assembly 200 includes an inner burner ring 202. Inner burner ring 202 may be inward firing with a swirling flame pattern. As discussed in greater detail below, burner assembly 200 includes features for managing or mitigating heat at top panel 142 (e.g., to prevent damage thereto). Burner assembly 200 defines an axial direction A, a radial direction R, and a circumferential direction C.

When assembled, burner assembly 200 is positioned at top panel 142. As noted above, top panel 142 may include multiple discrete elements or, alternatively, a single integral unitary piece (e.g., formed from sheet metal). Thus, burner assembly 200 may be positioned at a specific separable portion of top panel 142 (e.g., a mounting pan mounted to or supported on a support plate of top panel 142). Burner assembly 200 includes an annular burner body 210. Annular burner body 210 is positioned on top panel 142 at a top surface 170 of top panel 142. For example, annular burner body 210 may rest on top panel 142 at top surface 170 of top panel 142 such that annular burner body 210 is not fastened or otherwise mechanically fixed to top panel 142. Thus, a user may simply lift annular burner body 210 upwardly away from top panel 142 to remove annular burner body 210 from top panel 142.

Annular burner body 210 defines a central combustion zone 212. Annular burner body 210 also defines a plurality of flame ports 214 (e.g., at or facing central combustion zone 212). Flame ports 214 may be distributed, for example, along the circumferential direction C, about central combustion zone 212 upstream from a mixing chamber 216. Gaseous fuel is thus flowable from mixing chamber 216 within annular burner body 210 into central combustion zone 212 through flame ports 214. Flame ports 214 may also be oriented such that the gaseous fuel flows in a swirling pattern from flame ports 214 into central combustion zone 212. In certain embodiments, annular burner body 210 includes an inner side wall 218 and an outer side wall 219. Inner side wall 218 may extend around central combustion zone 212 (e.g., along the circumferential direction C). Flame ports 214 may be formed on or extend through inner side wall 218 (e.g., along the radial direction R, between mixing chamber 216 and central combustion zone 212). Outer side wall 219 may extend around inner side wall 218 (e.g., along the circumferential direction C). Outer side wall 219 may also be spaced from inner side wall 218 (e.g., along the radial direction R). Mixing chamber 216 may be defined and positioned between inner and outer side walls 218, 219 (e.g., along the radial direction R, within annular burner body 210). Annular burner body 210 is open at central combustion zone 212. For example, no portion or component of annular burner body 210 may extend (e.g., inward or otherwise along the radial direction R) into central combustion zone 212. In some embodiments, no fuel-providing structure extends into the central combustion zone 212. Top panel 142 may be exposed through annular burner body 210 at central combustion zone 212. Specifically, a circumferentially bounded portion of top panel 142 (e.g., bounded by annular burner body 210) may be exposed along the vertical direction. In such a manner, spills from utensils above burner assembly 200 may flow through central combustion zone 212 to top panel 142, and such spills may pass through burner assembly 200 without contacting burner assembly 200 at central combustion zone 212. Staining of annular burner body 210 may be reduced or limited by allowing spills to pass through annular burner body 210 at central combustion zone 212.

Top panel 142 may also be continuous or imperforate directly below central combustion zone 212. Thus, spills passing through central combustion zone 212 may collect on top panel 142 and not flow through top panel 142. A user may easily access and clean such spills on top panel 142 by removing annular burner body 210 from top panel 142. In such a manner, burner assembly 200 may facilitate cleaning of spills from utensils positioned over burner assembly 200.

Burner assembly 200 also includes a fuel manifold 220. Fuel manifold 220 is positioned beneath top panel 142 (e.g., along axial direction A). Thus, fuel manifold 220 may be positioned at or proximate to a bottom surface 172 of the top panel 142 and burner body 210 may be positioned at or proximate to a top surface 170 of the top panel 142. Annular burner body 210 is fluidly coupled to fuel manifold 220 upstream from mixing chamber 216 such that the gaseous fuel is flowable from fuel manifold 220 into mixing chamber 216 of annular burner body 210. For example, fuel manifold 220 has an outlet passage 222. The gaseous fuel is flowable from fuel manifold 220 through outlet passage 222 into mixing chamber 216 of annular burner body 210.

As shown, burner body 210 has a vertical Venturi mixing tube 224. Venturi mixing tube 224 has an inlet 227 to a flow passage in fluid communication with the mixing chamber 216. Annular burner body 210 may include a plurality of Venturi mixing tubes 224 positioned at different locations along the circumferential direction C. For instance, the plurality of Venturi mixing tubes 224 may be substantially evenly spaced apart from one another. In various embodiments, the annular burner body includes two or more Venturi mixing tubes 224, such as three Venturi mixing tubes, or other appropriate quantity to provide a fuel-air mixture to mixing chamber 216.

Fuel manifold 220 has a fuel nozzle bracket 225. In some embodiments, the fuel manifold 220 including the fuel nozzle bracket 225 forms a horizontally extending flow passage. However, in other embodiments, the fuel manifold 220, or furthermore, the fuel nozzle bracket 224, forms a vertically extending flow passage. Fuel nozzle bracket 225 forms an inlet 226 to a fuel chamber 229. The fuel chamber 229 may form an annular fuel chamber having an inlet opening at inlet 226 and an outlet opening at outlet passage 222. Fuel nozzle bracket 225 may be positioned at one side portion of fuel manifold 220. Outlet passage 222 may be positioned at different locations along the circumferential direction C. For instance, a plurality of outlet passages 222 may be substantially evenly spaced apart from one another. In various embodiments, the fuel manifold 220 includes two or more outlet passages 222, such as three outlet passages, or a quantity corresponding to a quantity of vertical Venturi mixing tubes 224, such as to provide a gaseous fuel through the outlet passage 222 to a respective vertical Venturi mixing tube 224.

A fuel nozzle (not shown) may be positioned at and oriented towards inlet 226 of fuel nozzle bracket 225. In particular, the fuel nozzle may be mounted to the fuel nozzle bracket 225 such that the fuel nozzle is spaced from fuel chamber 229 (e.g., along the radial direction R). The fuel nozzle may be connected to a supply line for gaseous fuel, such as propane or natural gas, and the gaseous fuel may flow from the fuel nozzle to inlet 226 of fuel nozzle bracket 225 and fuel chamber 229.

In various embodiments, the fuel manifold 220 may include at first fuel manifold body 2201 and a second fuel manifold body 2202. Each fuel manifold body 2201, 2202 may form an annular structure including walls spaced apart from one another to form the fuel chamber 229 between the first and second fuel manifold bodies, 2201, 2202. In some embodiments, the first fuel manifold body 2201 includes the fuel nozzle bracket 225. The second fuel manifold body 2202 may mate to one another, such as to form the fuel chamber 229 as a closed plenum having openings to the inlet 226 and outlet 222. For instance, first fuel manifold body 2201 may position atop the second fuel manifold body 2202.

First fuel manifold body 2201 may have an outlet fuel nozzle 228 at which the outlet passage 222 is formed. The outlet fuel nozzle 228 may form a vertical outlet fuel nozzle 228 having a vertically positioned outlet passage 222. The vertical outlet passage 222 is spaced apart along the axial direction A from the vertical Venturi mixing tube 224. In various embodiments, the outlet passage 222 is positioned at substantially similar locations along the circumferential direction C as the vertical Venturi mixing tube 224.

The gaseous fuel is received through inlet 226 into fuel chamber 229 and pushed out of the chamber 229 through outlet passage 222. The gaseous fuel egressing the outlet passage 222 may entrain air from the space between the outlet passage 222 and Venturi inlet 227 at the vertical Venturi mixing tube 224, and the gaseous fuel may mix with the entrained air within vertical Venturi mixing tube 224. The mixture of the gaseous fuel and air may mix at mixing chamber 216 and egress through flame ports 214.

Outlet passages 222 may be distributed or sized to facilitate uniform flow of the gaseous fuel into openings 227. For example, outlet passages 222 may be, for example, uniformly, distributed about central combustion zone 212.

In some embodiments, mixing tube 224 extends through top panel 142 (e.g., along the axial direction A) toward fuel manifold 220 from the annular burner body 210. In particular, top panel 142 defines a plurality of openings 174. Each Venturi mixing tube 224 is received within and extends through a respective one of openings 174 of top panel 142. Thus, each opening 174 of top panel 142 is aligned with a respective mixing tube 224. Each opening 174 of top panel 142 may also be sized complementary with the respective mixing tube 224. Such sizing of openings 174 and mixing tubes 224 may reduce leakage of spills through top panel 142.

In certain embodiments, burner assembly 200 also includes a plurality of inlet passages 230. Inlet passages 230 extend downwardly (e.g., along the axial direction A) from the mixing chamber 216 towards top panel 142. Each inlet passage 230 may form an outlet end of a respective Venturi mixing tube 224. Thus, the gaseous fuel-air mixture is flowable from Venturi mixing tube 224 into mixing chamber 216 through inlet passages 230.

In various embodiments, annular burner body 210 is suspended over fuel manifold 220 on top panel 142. In particular, vertical Venturi mixing tubes 224 may extend (e.g., along the axial direction A) from annular burner body 210 to top panel 142 such that outer walls of the mixing tubes 224 rest or abut within openings 174 through the top panel 142 and suspend the annular burner body 210 over the outlet passages 222 at the fuel manifold 220 (e.g., along the axial direction A). With annular burner body 210 suspended over fuel manifold 220, gaseous fuel flowed from the outlet passage 222 at the fuel manifold 220 pulls air from an atmospheric pressure volume formed between the mixing tube inlet 227 and the fuel manifold outlet passage 222. Additionally, contact between the burner body 210 and the top panel 142 may form, or include, a seal that prevents or limits fluid communication from the top surface 170 through the opening 174. In some embodiments, a lip or raised wall 143 (e.g., along the axial direction A) may extend from the top surface 170 toward the burner body 210, such as to form a raised barrier above a radial extension of the top surface 170. The lip or raised wall 143 may extend around each opening 174 and contact the burner body 210 around the Venturi mixing tube 224.

Figure 4:
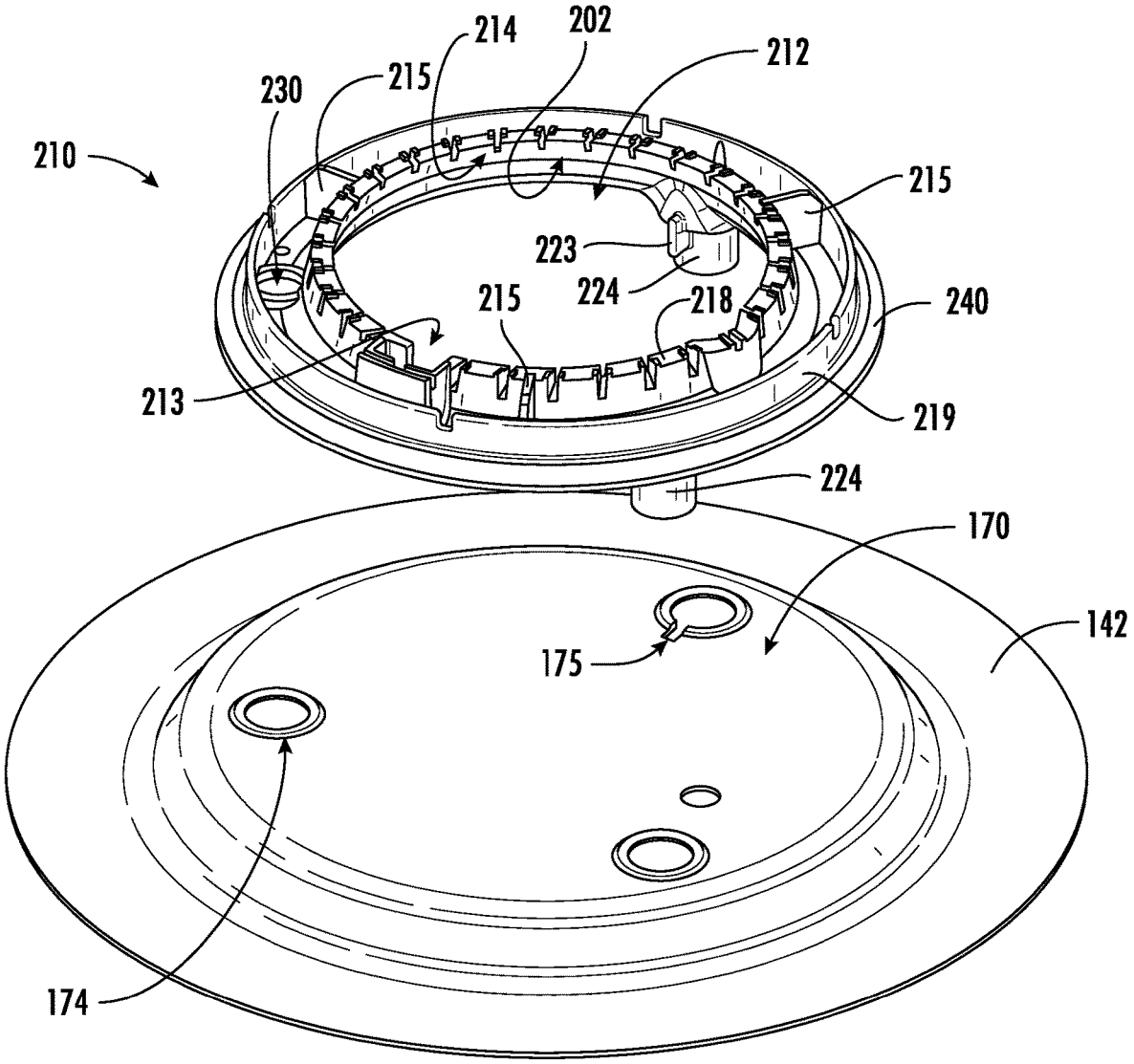
FIG. 4 provides a perspective view of components of an exemplary burner assembly in accordance with embodiments of the present disclosure.
Figure 5:
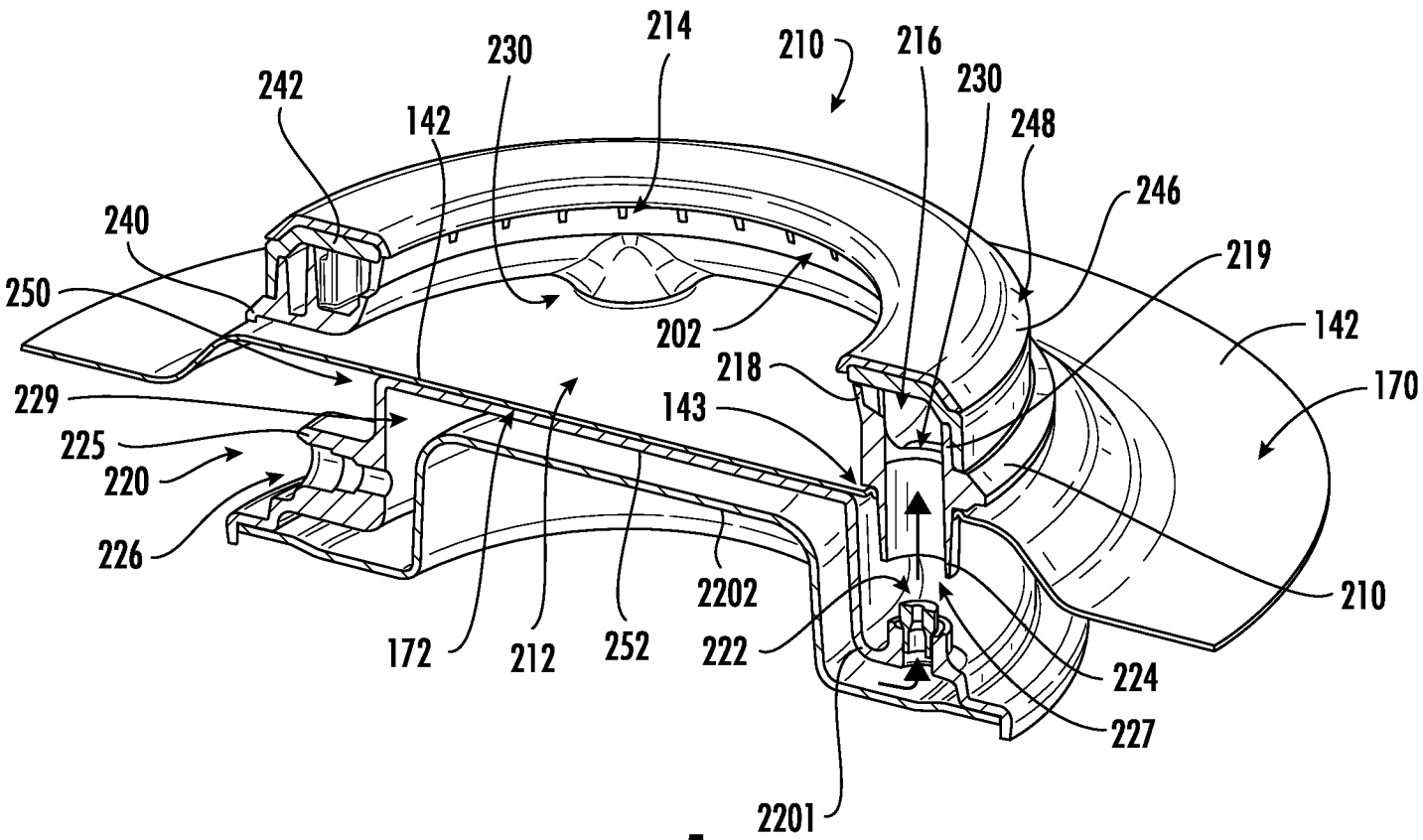
FIG. 5 provides a cutaway perspective view of an exemplary burner body of the burner assembly of FIG. 3 in accordance with embodiments of the present disclosure.
Figure 6:
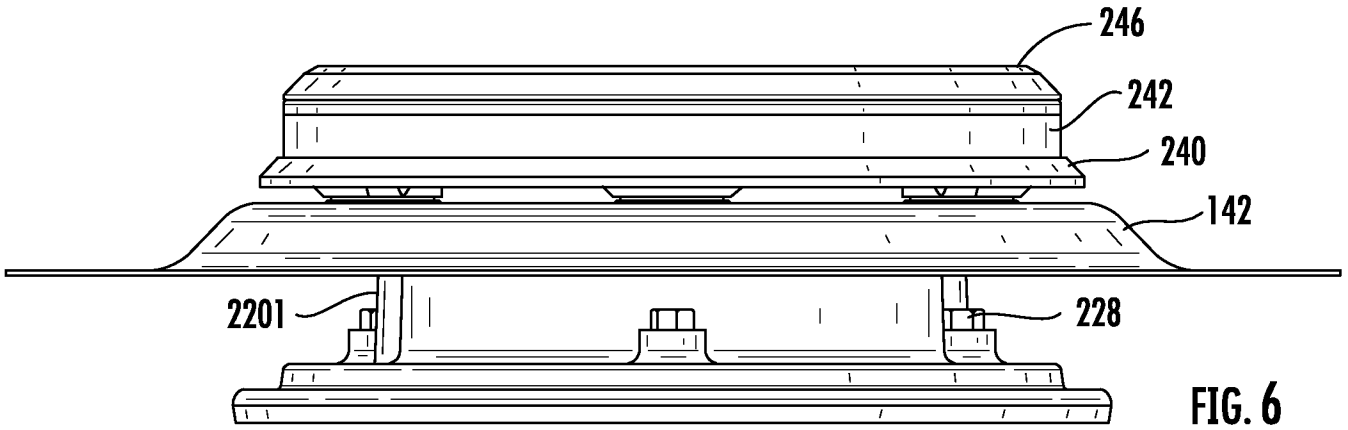
FIG. 6 provides a side view of an exemplary burner assembly in accordance with embodiments of the present disclosure.
Figure 7:
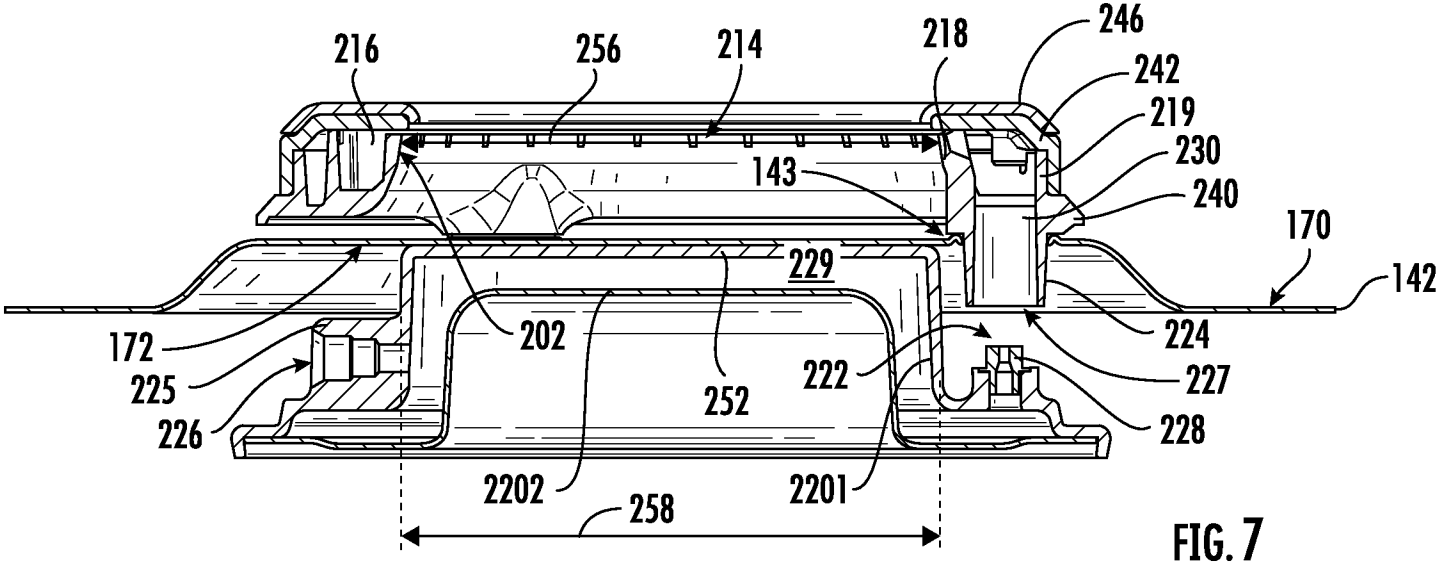
FIG. 7 provides a cutaway side view of the exemplary burner assembly of FIG. 6 in accordance with embodiments of the present disclosure.
Figure 8:
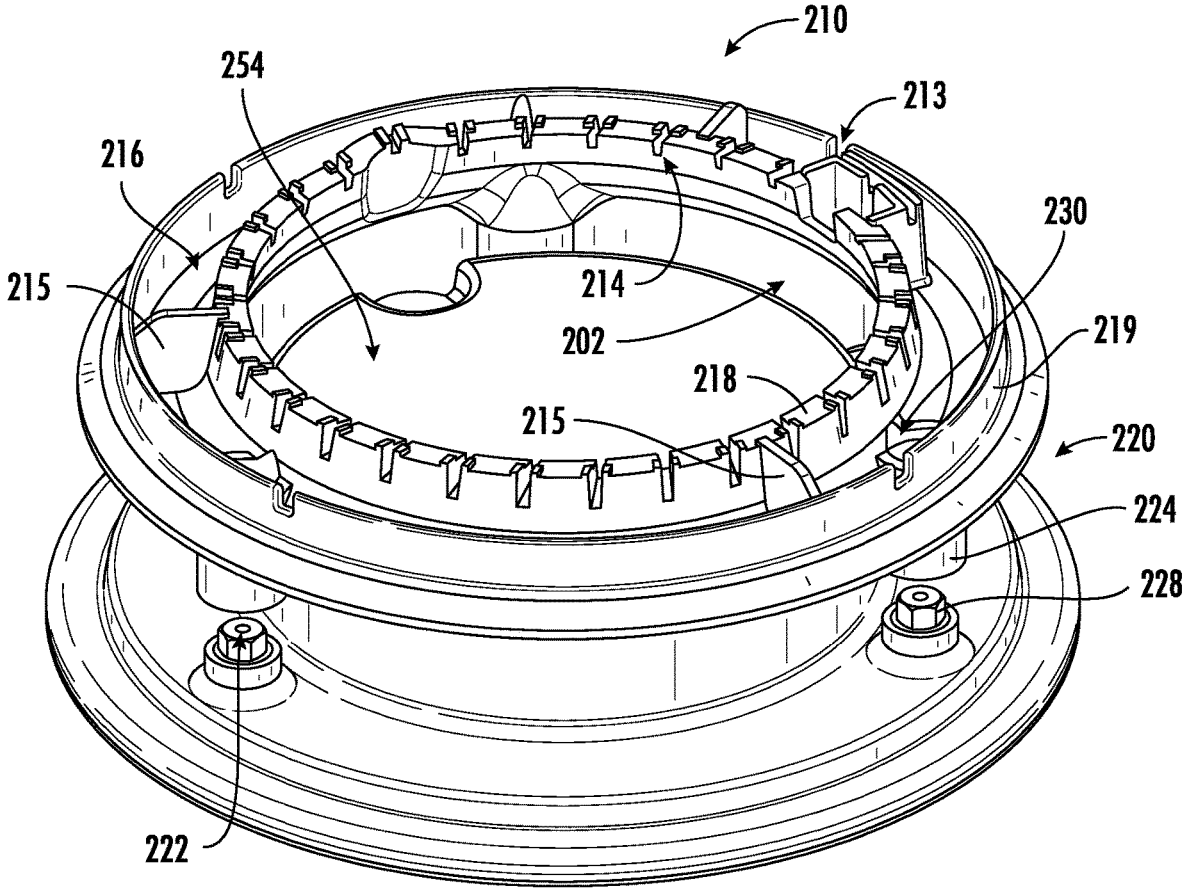
FIG. 8 provides a perspective view of components of an exemplary burner assembly in accordance with embodiments of the present disclosure.
Figure 9:
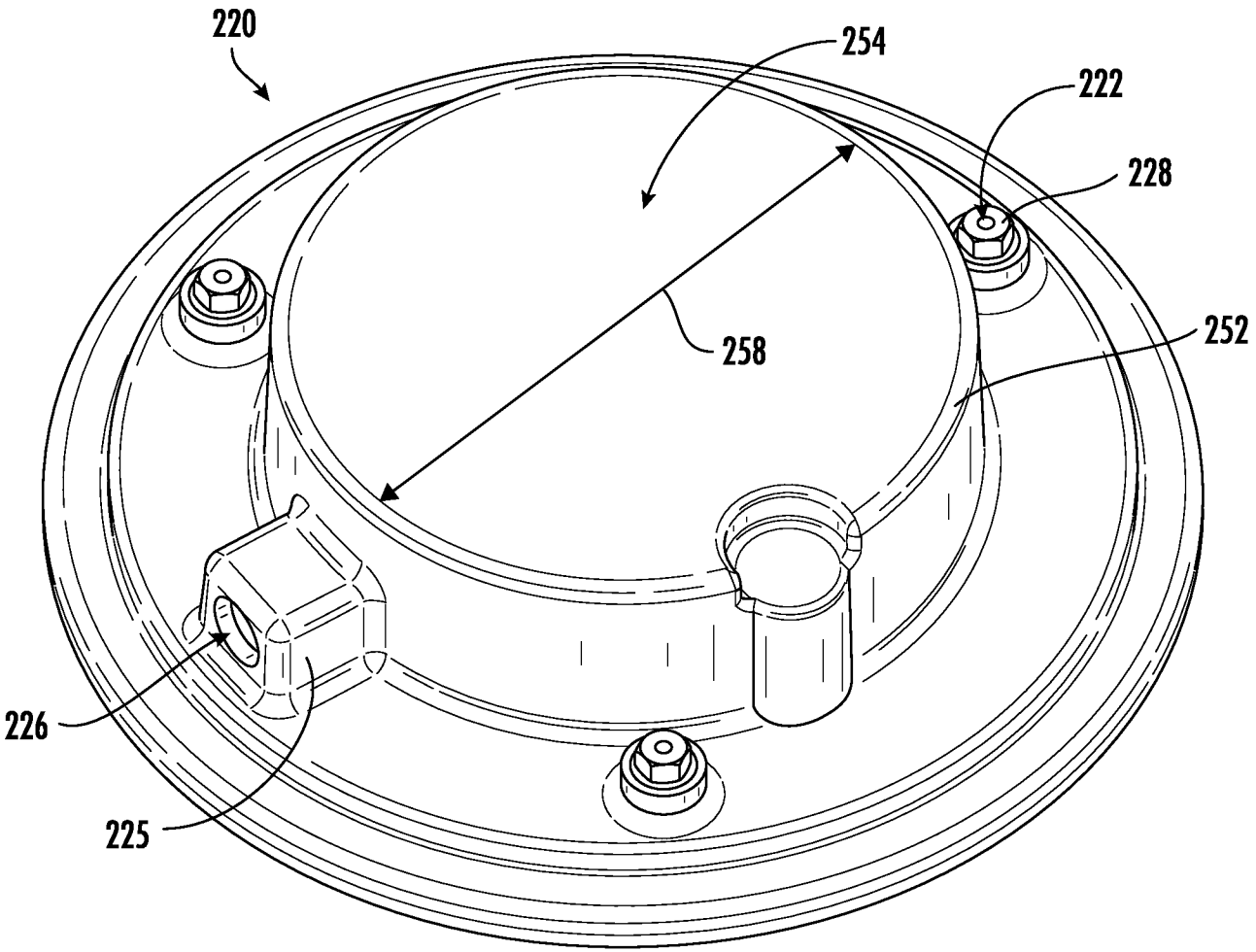
FIG. 9 provides a perspective view of components of an exemplary burner assembly in accordance with embodiments of the present disclosure.
Figure 10:
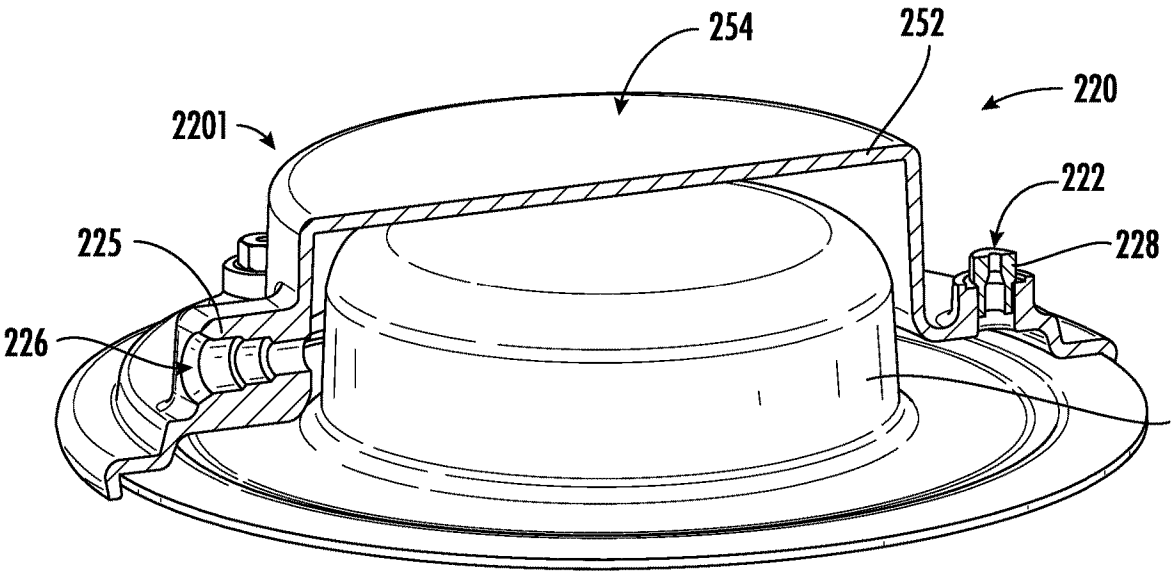
FIG. 10 provides a partial cutaway perspective view of components of an exemplary burner assembly in accordance with embodiments of the present disclosure.
Figure 11:
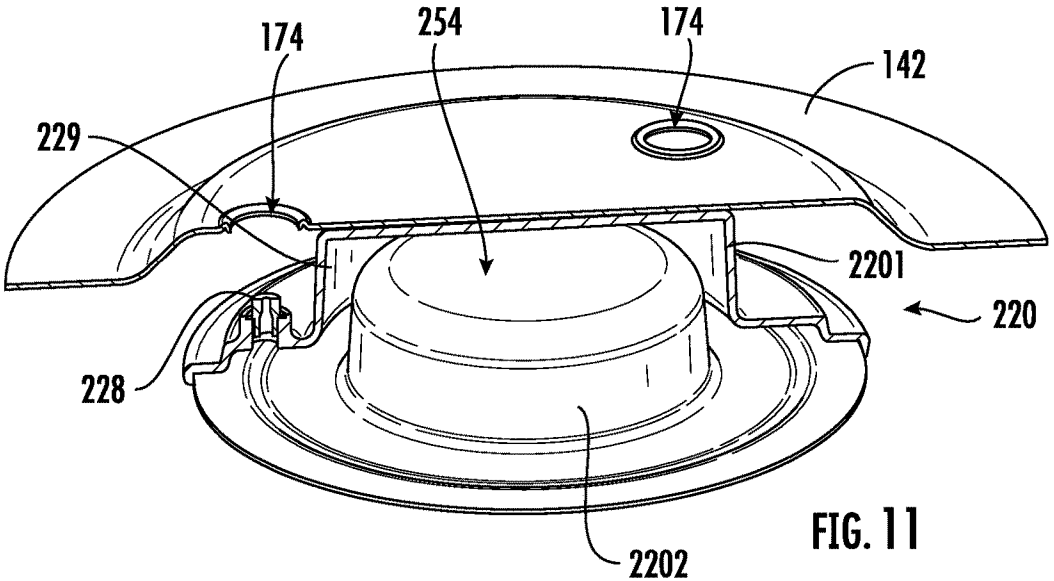
FIG. 11 provides a partial cutaway perspective view of components of an exemplary burner assembly in accordance with embodiments of the present disclosure.

Referring to FIG. 4, in some embodiments, one or more of opening 174 includes a notch 175 corresponding to a key 223 formed at an exterior surface of the vertical Venturi mixing tube 224. The key 223 may form a radially extending wall (e.g., extending radially inward toward the center or radially outward) extending along the axial direction A. The key 223 and notch 175 may together promote desired clocking of the burner body 210 relative to the fuel manifold 220.

As shown, annular burner body 210 may include an annular burner base 240 and an annular burner head 242. Annular burner base 240 includes inlet passages 230 and may be positioned on or over top panel 142. Annular burner head 242 may be positioned on annular burner base 240 to form mixing chamber 216 of annular burner body 210. Thus, annular burner base 240 may form a bottom wall of mixing chamber 216, and annular burner head 242 may form a top wall of mixing chamber 216. Annular burner base 240 or annular burner head 242 may be formed of a cast metal, such as cast iron or cast aluminum alloy.

In various embodiments, a partition wall 215 extends through the mixing chamber 216 from the inner side wall 218 to the outer side wall 219. The partition wall 215 generally extends from the burner base 240 to the burner head 242. The partition wall 215 furcates the mixing chamber 216 into two or more fluidly separate plenums. For example, FIG. 4 depicts the mixing chamber 216 having three plenums separated by partition walls 215. In some embodiments, the furcated mixing chambers 216 may be substantially equal to one another in volume, arcuate section, or both. Accordingly, partition walls 215 may be positioned substantially equidistant from one another along the circumferential direction C.

In some embodiments, a damper assembly 213 is positioned between the inner and outer side walls 218, 219 and including an opening in fluid communication with the combustion zone 212. The damper assembly 213 may form an acoustic damper, such as to mitigate the effects of undesired pressure fluctuations, acoustic resonance, or pressure wave propagation related to the combustion process.

In some embodiments, annular burner body 210 may also include an annular burner cap 246. For instance, annular burner cap 246 may be positioned on annular burner head 242 such that annular burner cap 246 covers annular burner head 242. Annular burner cap 246 may reduce staining of annular burner base 240 or annular burner head 242. For example, annular burner cap 246 may include an enamel coating on an outer surface 248 of annular burner cap 246. For example, the enamel coating may face away from annular burner head 242 and be visible to a user of burner assembly 200 when burner assembly 200 is positioned on top panel 142. The enamel coating on annular burner cap 246 may be easier to clean than and less stainable by spills from cooking utensils than the cast metal of annular burner base 240 or annular burner head 242.

As shown, a thermal break 250 is provided in or below the combustion zone 212. Specifically, thermal break 250 may be provided at a portion of top panel 142, radially inward from annular burner body 210 to advantageously prevent damage or otherwise manage heat generated within combustion zone 212. For instance, thermal break 250 may be formed along the circumferentially bounded portion of the top panel 142 below the plurality of flame ports 214. Thus, heat absorbed at the portion of the top panel 142 vertically or axially aligned with the central combustion zone 212 may be advantageously reduced.

In some embodiments, thermal break 250 is further formed between the annular burner body 210 and above fuel chamber 229 at the fuel manifold 220. Thus, relative to a vertical direction (e.g., parallel to the axial direction A), thermal break 250 may be disposed below the annular burner body 210 and above a radially extending portion of the fuel chamber 229. In some embodiments, thermal break 250 is radially inward from annular burner body 210 and may, thus, be circumferentially bounded by annular burner body 210 while still being disposed lower than the annular burner body 210.

In various embodiments, thermal break 250 may include a conductive heat sink 252 formed from a thermally conductive metal material (e.g., aluminum or steel, including alloys thereof) below top panel 142. In some embodiments, conductive heat sink 252 extends (e.g., upward along the vertical or axial direction A) from the fuel chamber 229 to a top face 254. Thus, a base or bottom of conductive heat sink 252 may be disposed on first fuel manifold portion 2201. Additionally, or alternatively, top face 254 may be formed as a planar surface or surface having a shape that otherwise matches or complements the bottom surface 172. During use (e.g., cooking or burning operations of burner assembly 200), heat received at top face 254 may be conducted away from top panel 142 and through conductive heat sink 252 to fuel chamber 229. Heat or thermal energy distributed to gaseous fuel at the fuel chamber 229 may further promote combustion efficiency while allowing heat to transfer from the top panel 142.

In some embodiments, top face 254 is disposed beneath (e.g., in contact or conductive thermal communication with) a bottom surface 172 of top panel 142. Specifically, top face 254 may be disposed beneath the bottom surface 172 at the circumferentially bounded portion of the top panel 142. Thus, top face 254 spans at least a portion of the horizontal area defined by the central combustion zone 212 (e.g., in the radial plane). Moreover, referring to FIG. 7, the horizontal area of the central combustion zone 212 has a horizontal zone radius or width 256 (e.g., maximum width along the radial direction R). Similarly, referring to FIGS. 7 and 9 top face 254 may define a horizontal area having a horizontal face radius or width 258 (e.g., maximum width along the radial direction R or parallel to the horizontal zone width 256). As shown, the horizontal area of the top face 254 may overlap the horizontal area of the central combustion zone 212 (e.g., in the radial plane viewed from above or below assembly 200). For instance, the horizontal area of the top face 254 may be axially aligned with the horizontal area of the central combustion zone 212 (e.g., such that the horizontal areas are coaxial with each other). In some such embodiments, the horizontal face width 258 may be greater than (e.g., define a measured distance) 40% of the horizontal zone width 256; such as greater than or equal to 50%, 75%, or 95%. In additional or alternative embodiments, the horizontal face width 258 may be less than or equal to the horizontal zone width 256.

As generally depicted in FIGS. 3-11, top panel 142 may be formed as a flat or planar panel (e.g., at the central combustion zone 212). In other embodiments, top panel 142 at top face 254 may form a negative embossing at the circumferentially bounded portion of top panel 142. In some embodiments, the top face 254 forming a negative embossing may extend downward (e.g., along the vertical or axial direction A). For instance, negative embossing may extend away from annular burner body 210 to a predefined depth (e.g., defined at a lowermost upward-facing surface of top panel 142). In some embodiments, the predefined depth may be greater than or equal to 0.1 inches, 0.2 inches, or 0.5 inches, or less than 0.75 inches.

As shown, thermal break 250 may include a conductive heat sink 252 formed from a thermally conductive metal material (e.g., aluminum or steel, including alloys thereof) below top panel 142. In some embodiments, conductive heat sink 252 extends (e.g., upward along the vertical or axial direction A) from fuel manifold 220 to a top face 254. Thus, the base or bottom of conductive heat sink 252 may be disposed on or formed at fuel manifold 220 while top face 254 defines the upper end of conductive heat sink 252. In some embodiments, conductive heat sink 252 may be formed as an integral unitary (e.g., monolithic) element with at least a portion of fuel manifold 220.

Embodiments of the burner assembly 200 provided herein advantageously provide improved burning efficiency and heat transfer properties (e.g., interior portion cooling) while further mitigating or eliminating staining and dirt associated with spillage, such as by removing exposed burner surfaces that may be adversely affected from spillage. Additionally, embodiments provided herein may provide a simple design, such as to obviate a need for tight tolerance surfaces and fits. Embodiments of the burner assembly provided herein may be formed from casting, additive manufacturing, or machining processes, or combinations thereof.

For instance, embodiments of the burner assembly 200 provided herein include an inward fired burner providing a substantially annular burner body with a hollow center. A vertical Venturi mixing tube or throat, such as two or more Venturi mixing throats, may form a volume within the burner body fluidly separate from one another. Each Venturi tube receives a flow of gaseous fuel from an outlet passage at the fuel manifold, and a flow of air entrained by the flow of gaseous fuel entering the burner body. The fuel manifold may form a plurality of outlet passages corresponding to each Venturi tube that provide gas under pressure via an internal mixing chamber. The fuel manifold may further form a substantially round heat sink at its center urged against the cooktop surface, such as to reduce heating of the cooktop surface from the central combustion zone.

Embodiments of the burner assembly 200 provided herein may allow substantially less material and fewer machining processes for construction, such as 50% or greater reduction in material. Additionally, or alternatively, separation of the burner body and the fuel manifold may allow gaseous fuel to inject directly into the Venturi mixing tube at the burner body without mating interfaces above atmospheric pressure between the fuel manifold and the burner body. Separately formed and positioned fuel manifold and burner body may substantially reduce or eliminate leaks. Additionally, or alternatively, such separately formed and positioned structures may obviate a need for tight tolerance or tight fit machined surfaces.

Further aspects of the disclosure are provided in the following clauses:

1. A cooktop appliance, including a top panel and a gas burner assembly positioned at the top panel, the gas burner assembly including an annular burner body positioned at a top surface of the top panel, the annular burner body forming a central combustion zone, a plurality of flame ports at the central combustion zone, and a mixing chamber upstream from the plurality of flame ports to permit a fuel-air mixture to flow into the central combustion zone through the plurality of flame ports, the annular burner body being open at the central combustion zone such that a circumferentially bounded portion of the top panel is vertically exposed through the annular burner body at the central combustion zone, and a fuel manifold positioned beneath the top panel and upstream from the mixing chamber at the burner body, the fuel manifold forming an outlet passage spaced apart from an inlet at the burner body such that gaseous fuel is flowable from the outlet passage at the fuel manifold into the mixing chamber through the inlet at the burner body, and such that air is entrained into the mixing chamber by the flow of gaseous fuel entering the mixing chamber through the inlet at the burner body.

2. The cooktop appliance of any one or more clauses herein, wherein a space is formed between the outlet passage at the fuel manifold and the inlet at the burner body such that gaseous fuel egressed from the outlet passage entrains atmospheric air from the space between the outlet passage and the inlet.

3. The cooktop appliance of any one or more clauses herein, the burner body including a vertical mixing tube, wherein the inlet to the mixing passage is formed at the mixing tube.

4. The cooktop appliance of any one or more clauses herein, the burner body including a plurality of vertical mixing tubes substantially equally spaced apart from one another along a circumferential direction, wherein the inlet to the mixing passage is formed at respective mixing tubes.

5. The cooktop appliance of any one or more clauses herein, the fuel manifold including a plurality of fuel nozzles, wherein the outlet passage is formed at respective fuel nozzles, and wherein the fuel nozzles and mixing tubes are positioned at corresponding circumferential positions spaced apart from one another along an axial direction.

6. The cooktop appliance of any one or more clauses herein, the burner body including a partition wall extending through the mixing chamber to furcate the mixing chamber into two or more fluidly separate plenums.

7. The cooktop appliance of any one or more clauses herein, wherein a respective mixing tube is positioned in along the circumferential direction in fluid communication with a respective plenum of the furcated mixing chamber.

8. The cooktop appliance of any one or more clauses herein, the fuel manifold including an inlet opening forming a flow passage through which gaseous fuel is received, wherein the outlet passage is in fluid communication with the inlet opening to egress the flow of gaseous fuel.

9. The cooktop appliance of any one or more clauses herein, the fuel manifold forming a circumferentially extending fuel chamber between an inlet opening and the outlet passage.

10. The cooktop appliance of any one or more clauses herein, the fuel manifold including a first fuel manifold body and a second fuel manifold body, the first and second fuel manifold bodies forming an annular structure spaced apart from one another to form a fuel chamber therebetween, the fuel chamber forming a closed plenum including an inlet opening configured to receive a flow of gaseous fuel and an outlet passage configured to egress the gaseous fuel to the burner body.

11. The cooktop appliance of any one or more clauses herein, including a thermal break formed along the circumferentially bounded portion of the top panel below the plurality of flame ports, wherein the thermal break includes a conductive heat sink extending from the fuel manifold to a top face disposed beneath a bottom surface of the top panel at the circumferentially bounded portion of the top panel such that the conductive heat sink is in conductive thermal communication with the bottom surface of the top panel.

12. The cooktop appliance of any one or more clauses herein, wherein the central combustion zone has a horizontal zone width, wherein the top face of the conductive heat sink has a horizontal face width that is greater than 40% of the horizontal zone width.

13. The cooktop appliance of any one or more clauses herein, wherein no portion of the annular burner body is positioned within the central combustion zone above the top panel.

14. A gas burner assembly for a cooktop appliance, the burner assembly including an annular burner body disposable at a top surface of a top panel of the cooktop appliance, the annular burner body forming a central combustion zone, a plurality of flame ports at the central combustion zone, and a mixing chamber upstream from the plurality of flame ports to permit a fuel-air mixture to flow into the central combustion zone through the plurality of flame ports, the annular burner body being open at the central combustion zone such that a circumferentially bounded portion of the top panel is vertically exposed through the annular burner body at the central combustion zone, and a fuel manifold disposable beneath the top panel and upstream from the mixing chamber at the burner body, the fuel manifold forming an outlet passage spaced apart from an inlet at the burner body such that gaseous fuel is flowable from the outlet passage at the fuel manifold into the mixing chamber through the inlet at the burner body, and such that air is entrained into the mixing chamber by the flow of gaseous fuel entering the mixing chamber through the inlet at the burner body.

15. The burner assembly of any one or more clauses herein, wherein a space is formed between the outlet passage at the fuel manifold and the inlet at the burner body such that gaseous fuel egressed from the outlet passage entrains atmospheric air from the space between the outlet passage and the inlet.

16. The burner assembly of any one or more clauses herein, the burner body including a vertical Venturi mixing tube, wherein the inlet to the mixing passage is formed at the mixing tube.

17. The burner assembly of any one or more clauses herein, the fuel manifold including a fuel nozzle, wherein the outlet passage is formed at the fuel nozzle, and wherein the fuel nozzle and Venturi mixing tube are positioned at a corresponding circumferential position spaced apart from one another along an axial direction.

18. The burner assembly of any one or more clauses herein, the burner body including a partition wall extending through the mixing chamber to furcate the mixing chamber into two or more fluidly separate plenums.

19. The burner assembly of any one or more clauses herein, the fuel manifold forming a circumferentially extending fuel chamber between an inlet opening and the outlet passage.

20. The burner assembly of any one or more clauses herein, including a thermal break formed along the circumferentially bounded portion of the top panel below the plurality of flame ports, wherein the thermal break includes a conductive heat sink extending from the fuel manifold to a top face disposed beneath a bottom surface of the top panel at the circumferentially bounded portion of the top panel such that the conductive heat sink is in conductive thermal communication with the bottom surface of the top panel.

21. A cooktop appliance including the burner assembly of any one or more clauses herein.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A cooktop appliance, comprising:

a top panel; and a gas burner assembly positioned at the top panel, the gas burner assembly comprising an annular burner body positioned at a top surface of the top panel, the annular burner body forming a central combustion zone, a plurality of flame ports at the central combustion zone, and a mixing chamber upstream from the plurality of flame ports to permit a fuel-air mixture to flow into the central combustion zone through the plurality of flame ports, the annular burner body being open at the central combustion zone such that a circumferentially bounded portion of the top panel is vertically exposed through the annular burner body at the central combustion zone; and a fuel manifold positioned beneath the top panel and upstream from the mixing chamber at the burner body, the fuel manifold forming an outlet passage spaced apart from an inlet at the burner body such that gaseous fuel is flowable from the outlet passage at the fuel manifold into the mixing chamber through the inlet at the burner body, and such that air is entrained into the mixing chamber by the flow of gaseous fuel entering the mixing chamber through the inlet at the burner body; and a thermal break formed along the circumferentially bounded portion of the top panel below the plurality of flame ports, wherein the thermal break comprises a conductive heat sink extending from the fuel manifold to a top face disposed beneath a bottom surface of the top panel at the circumferentially bounded portion of the top panel such that the conductive heat sink is in conductive thermal communication with the bottom surface of the top panel.

2. The cooktop appliance of claim 1, wherein a space is formed between the outlet passage at the fuel manifold and the inlet at the burner body such that gaseous fuel egressed from the outlet passage entrains atmospheric air from the space between the outlet passage and the inlet.

3. The cooktop appliance of claim 1, the burner body comprising a vertical mixing tube, wherein the inlet to the mixing chamber is formed at the mixing tube.

4. The cooktop appliance of claim 1, the burner body comprising a plurality of vertical mixing tubes substantially equally spaced apart from one another along a circumferential direction, wherein the inlet to the mixing chamber is formed at respective mixing tubes.

5. The cooktop appliance of claim 4, the fuel manifold comprising a plurality of fuel nozzles, wherein the outlet passage is formed at respective fuel nozzles, and wherein the fuel nozzles and vertical mixing tubes are positioned at corresponding circumferential positions spaced apart from one another along an axial direction.

6. The cooktop appliance of claim 4, the burner body comprising a partition wall extending through the mixing chamber to furcate the mixing chamber into two or more fluidly separate plenums.

7. The cooktop appliance of claim 6, wherein respective mixing tubes are positioned along the circumferential direction in fluid communication with respective plenums of the furcated mixing chamber.

8. The cooktop appliance of claim 1, the fuel manifold comprising an inlet opening forming a flow passage through which gaseous fuel is received, wherein the outlet passage is in fluid communication with the inlet opening to egress the flow of gaseous fuel.

9. The cooktop appliance of claim 1, the fuel manifold forming a circumferentially extending fuel chamber between an inlet opening and the outlet passage.

10. The cooktop appliance of claim 1, the fuel manifold comprising a first fuel manifold body and a second fuel manifold body, the first and second fuel manifold bodies forming an annular structure spaced apart from one another to form a fuel chamber therebetween, the fuel chamber forming a closed plenum comprising an inlet opening configured to receive a flow of gaseous fuel and the outlet passage configured to egress the gaseous fuel to the burner body.

11. The cooktop appliance of claim 1, wherein the central combustion zone has a horizontal zone width, wherein the top face of the conductive heat sink has a horizontal face width that is greater than 40% of the horizontal zone width.

12. The cooktop appliance of claim 1, wherein no portion of the annular burner body is positioned within the central combustion zone above the top panel.

13. A gas burner assembly for a cooktop appliance, the burner assembly comprising:

an annular burner body disposable at a top surface of a top panel of the cooktop appliance, the annular burner body forming a central combustion zone, a plurality of flame ports at the central combustion zone, and a mixing chamber upstream from the plurality of flame ports to permit a fuel-air mixture to flow into the central combustion zone through the plurality of flame ports, the annular burner body being open at the central combustion zone such that a circumferentially bounded portion of the top panel is vertically exposed through the annular burner body at the central combustion zone; and a fuel manifold disposable beneath the top panel and upstream from the mixing chamber at the burner body, the fuel manifold forming an outlet passage spaced apart from an inlet at the burner body such that gaseous fuel is flowable from the outlet passage at the fuel manifold into the mixing chamber through the inlet at the burner body, and such that air is entrained into the mixing chamber by the flow of gaseous fuel entering the mixing chamber through the inlet at the burner body; and a thermal break formed along the circumferentially bounded portion of the top panel below the plurality of flame ports, wherein the thermal break comprises a conductive heat sink extending from the fuel manifold to a top face disposed beneath a bottom surface of the top panel at the circumferentially bounded portion of the top panel such that the conductive heat sink is in conductive thermal communication with the bottom surface of the top panel.

14. The burner assembly of claim 13, wherein a space is formed between the outlet passage at the fuel manifold and the inlet at the burner body such that gaseous fuel egressed from the outlet passage entrains atmospheric air from the space between the outlet passage and the inlet.

15. The burner assembly of claim 13, the burner body comprising a vertical Venturi mixing tube, wherein the inlet to the mixing chamber is formed at the mixing tube.

16. The burner assembly of claim 15, the fuel manifold comprising a fuel nozzle, wherein the outlet passage is formed at the fuel nozzle, and wherein the fuel nozzle and Venturi mixing tube are positioned at a corresponding circumferential position spaced apart from one another along an axial direction.

17. The burner assembly of claim 13, the burner body comprising a partition wall extending through the mixing chamber to furcate the mixing chamber into two or more fluidly separate plenums.

18. The burner assembly of claim 13, the fuel manifold forming a circumferentially extending fuel chamber between an inlet opening and the outlet passage.

* * * * *